US005418984A

United States Patent [19]

Livingston, Jr.

[11] Patent Number: 5,418,984

[45] Date of Patent: May 30, 1995

[54] HYDROTHERAPY SEAT STRUCTURE FOR A HYDROTHERAPY SPA, TUB OR SWIMMING POOL

[75] Inventor: David R. Livingston, Jr., Williamsport, Pa.

[73] Assignee: Plastic Development Company - PDC, Williamsport, Pa.

[21] Appl. No.: 82,391

[22] Filed: Jun. 28, 1993

[51] Int. Cl.[6] ..... E03C 1/08

[52] U.S. Cl. ..... 4/541.1; 4/541.3; 601/154; 601/158; 601/160

[58] Field of Search ..... 4/541.1, 541.2, 541.3, 4/541.4, 541.5, 541.6; 128/65, 66; 601/154, 157, 158, 160

[56] References Cited

U.S. PATENT DOCUMENTS

| | | | |
|---|---|---|---|
| 2,714,725 | 8/1955 | Boone | 128/66 |
| 3,251,071 | 5/1966 | Wood | 4/541.5 |
| 3,556,089 | 1/1971 | Frazier et al. . | |
| 4,339,833 | 7/1982 | Mandell | 4/541.4 |
| 4,340,982 | 7/1982 | Hart et al. . | |
| 4,546,505 | 10/1985 | Wakenshaw | 4/541.3 |
| 4,692,950 | 9/1987 | Henkin et al. . | |
| 4,780,916 | 11/1988 | Sutton | 4/541.5 |
| 4,825,854 | 5/1989 | Henkin et al. . | |
| 4,860,392 | 8/1989 | Gardenier et al. . | |
| 4,903,352 | 2/1990 | Murakami | 4/541.3 |
| 5,090,403 | 2/1992 | Bucher | 4/541.5 |
| 5,172,433 | 12/1992 | Lake | 4/541.4 |

FOREIGN PATENT DOCUMENTS

| | | | |
|---|---|---|---|
| 154935 | 9/1985 | France | 4/541.3 |
| 2610518 | 8/1988 | France | 128/66 |
| 2162059 | 1/1986 | United Kingdom | 4/541.3 |

*Primary Examiner*—Henry J. Recla
*Assistant Examiner*—Charles R. Eloshway
*Attorney, Agent, or Firm*—Sughrue, Mion, Zinn, Macpeak & Seas

[57] ABSTRACT

A hydrotherapy spa includes an upwardly open, U-shaped, cross-sectional, waterproof spa shell defining a receptacle for holding water. The spa shell includes a horizontal seat portion and an integral seat back extending generally vertically upwardly therefrom. A water supply manifold is sealably mounted to the exterior of the spa shell, is spaced therefrom and forms a manifold chamber, with the supply manifold overlying a portion of the seat and the seat back. A plurality of small diameter apertures are formed in the spa shell opening to the manifold chamber. Water under pressure is circulated from the interior of the spa shell to an inlet port opening to the manifold chamber. The water is discharged through the small diameter apertures into the interior of the spa shell and against the back and buttocks of an occupant within the seat area seated at a hydrotherapy seat defined by the supply manifold and the seat and seat back of the spa shell which include the small diameter apertures. The occupant is gently massaged by the discharge of the circulated water through the small diameter apertures.

1 Claim, 1 Drawing Sheet

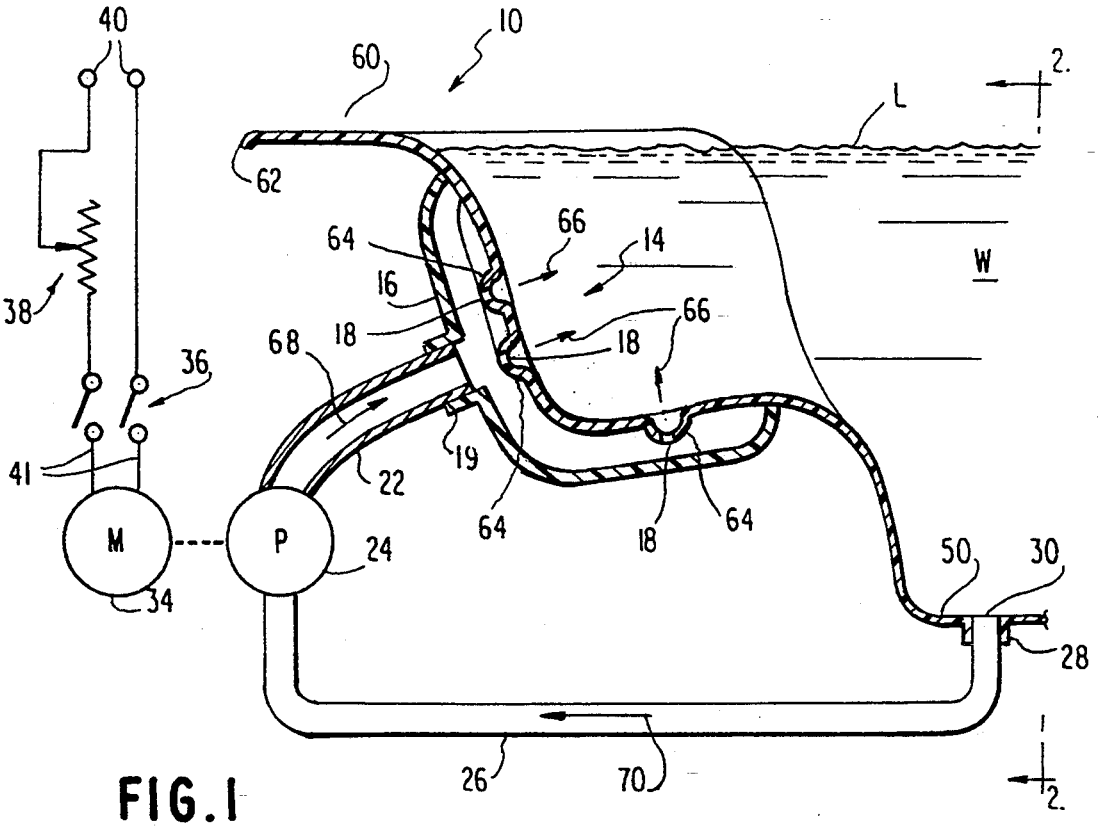
FIG. 1
FIG. 2
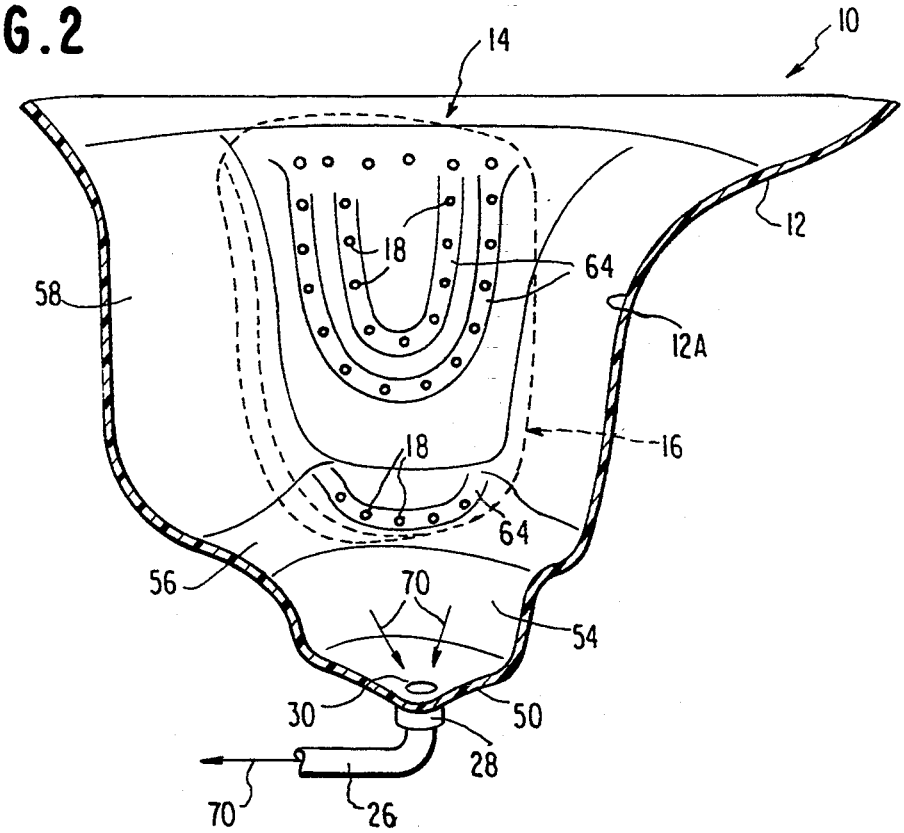

HYDROTHERAPY SEAT STRUCTURE FOR A HYDROTHERAPY SPA, TUB OR SWIMMING POOL

FIELD OF THE INVENTION

This invention relates to therapeutic baths or spas, and more particularly to a hydrotherapy seat structure integrated to the spa shell and for providing multiple streams of water in a defined seat area for gentle massaging of the back and seat of the person seated within the defined seat area of the spa shell.

BACKGROUND OF THE INVENTION

Many therapeutic spa tubs or swimming pools employ complex piping systems for the injection of water and air inside the tub area. The injection of water and air may be at such impact velocities as to be too harsh for the occupant. Conventional spas employ a plurality of high pressure jets distributed about the inner periphery of the spa shell, normally beneath a seat. The presence of venturi nozzles add air to create a bubbling stream of water for soothing the body of the occupant of the spa. Typically, the occupant must move to limit the length of time of an area of the body in direct contact with the bubbling streams of water. To effect massaging of the user's back, it is necessary for the occupant to lower or raise himself in the spa to vary the jet contact area on the back or other portion of the user's body.

It is therefore a primary object of the present invention to provide an improved hydrotherapy seat structure for a hydrotherapy spa at one or more predefined areas of a waterproof spa shell to create a plurality of small size water jets emanating from the back and seat area of the spa shell for low velocity impact against the back and buttocks of the occupant of the hydrotherapy seat, which may be effected at low cost and in which the impact velocity is limited to thereby prevent that velocity from being too harsh for the occupant of the hydrotherapy seat.

SUMMARY OF THE INVENTION

The invention is directed to an improvement within a hydrotherapy spa comprising a waterproof spa shell defining a receptacle for use as a spa, tub or swimming pool, the receptacle holding water and being of generally U-shaped cross-section and including one horizontal seat and an upwardly oblique back wall. The improvement comprises a manifold sealably fixed to the exterior surface of the waterproof spa shell and overlying at least a portion of the back wall proximate to the horizontal seat and being spaced therefrom and sealably fixed thereto to form a water manifold. The water manifold is provided with an inlet port receiving water under pressure circulated by a pump. A plurality of small diameter apertures are provided on the spa shell within at least the back wall proximate to the horizontal seat for ejecting water into the interior of the spa shell beneath the normal water level at low velocity against the back of an occupant of the seat for general massage of the occupant's back.

Preferably, a water circulation pipe, coupled at one end to the inlet port of the water manifold and at an opposite end to an inlet port within the spa shell and receiving water from the interior of the spa shell, incorporates a variable speed pump. In operation, the pump circulates water from the interior of the spa shell through the circulation loop for discharge through the inlet port of the water supply manifold to the manifold chamber defined by the supply manifold and the spa shell for low velocity injection into the interior of the spa shell through the plurality of small diameter apertures. An electrical motor coupled to the pump and driving the same may be selectively connected through a switch to a source of electrical power, with a suitable rheostat or other means controlling the current supply to the motor for driving the pump at a variable speed. The manifold may include a section extending beneath the horizontal seat and being provided with a plurality of small diameter apertures to cause jets of water at low velocity to enter the interior of the spa shell beneath the level of the water therein for impingement on the buttocks of the occupant within the hydrotherapy seat. The small diameter apertures within the spa shell at the back and seat may be disposed in rows so as to form uniform patterns of the water jets. The rows of apertures may be of U-shape, within recessed channels, and may be spaced from each other and nested as a group within at least the back wall of the spa shell. The inlet port may be defined by an inlet fitting integral with the supply manifold and projecting outwardly from the exterior of the water supply manifold in a direction away from the upwardly oblique hydrotherapy seat back wall. The spa shell may include a recessed foot well terminating in a horizontal bottom wall, with the bottom wall including the outlet port defined by a cylindrical outlet fitting sealably fixed to the spa shell bottom wall and sealably coupled to one end of the water circulation pipe. The water supply manifold may be formed from fiberglass reinforced molded resin or like material to that forming the spa shell and may be molded with or permanently, sealably attached to the exterior of the spa shell and may be internally shaped to deliver water under pressure internally of the manifold chamber via predefined patterns of small diameter apertures. The water supply manifold for the hydrotherapy seat may be plumbed with pipe to other piping, circulating water to and from a water heater or the like, or may operate separately with its own variable speed pump within a separate circulation loop open at one end, through the outlet fitting to a water outlet port for the spa shell, and at the opposite end to the inlet fitting of the water supply manifold.

A typical spa may contain several hydrotherapy seat structures or defined hydrotherapy seat areas.

BRIEF DESCRIPTION OF THE DRAWINGS

FIG. 1 is a longitudinal sectional view of a portion of a hydrotherapy spa through a hydrotherapy seat structure forming a preferred embodiment of the invention.

FIG. 2 is a transverse sectional view of the portion of the hydrotherapy spa of FIG. 1 taken about line 2—2 of FIG. 1.

DESCRIPTION OF THE PREFERRED EMBODIMENT

Referring to the drawings, the present invention is shown in a preferred embodiment as an improvement within a hydrotherapy spa indicated generally at 10 formed principally of a waterproof spa receptacle shell 12 of generally U-shape cross-section as per FIG. 2. The shell 12 is upwardly open and receives water W to form a hydrotherapy spa or bath enclosure, rising to a level L within the spa shell 12. The spa shell 12, is preferably of molded plastic or fiberglass reinforced molded plastic. Alternatively, it may be formed of concrete. It also may constitute a bathtub or swimming pool, may be of rectangular or circular form, or may be of asymmetrical shape. However, as shown in transverse cross-section as per FIG. 2 and in the longitudinal sectional view of FIG. 1, is upwardly open U-shape, and includes a relatively short length bottom wall 50, a short height, generally vertical well side wall, extending from the bottom wall 50 and defining a recessed portion on well 54 of the spa shell 12. An integral, generally horizontal seat portion 56 extends radially outwardly or laterally of the well 54. An upwardly and outwardly oblique seat back 58 rises from seat 56, and the spa shell 12 terminates in an outwardly flared horizontal rim 60 having in a downwardly directed, peripheral edge 62. The incorporation of the seat 56 about the interior of the spa shell 12 permits a number of occupants to be seated within that spa shell enclosure. Such construction and design is well known and used extensively in the industry.

The present invention is directed to a hydrotherapy seat indicated generally at 14 integrated into the spa shell, which occupies a limited area of a hydrotherapy spa or hot tub. Alternatively, one or more of the hydrotherapy seats 14 may be integrated into a conventional bathtub. The spa or hot tub may have a plurality of hydrotherapy seats as at 14 at various locations within the spa shell or equivalent hot tub shell, as for instance dual seats 14 diametrically opposite each other or, for a rectangular plan configured hydrotherapy spa, at all four corners thereof. In the illustrated embodiment, the interior surface 12A of the spa shell at the location of the hydrotherapy seat 14 is provided with a number of U-shaped channels 64 which are recessed into the spa shell 12 during the molding of the same. Most of the small diameter apertures or holes 18 reside within the channels 64 and are more or less evenly spaced from each other along the channels 64, as illustrated. Some holes 18 could be concentrated depending upon the desired spray pattern formed by the holes 18. It is noted that two of the channels of U-shaped form are nested within each other within the seat back 58, while a single channel 64 also of U-shape, within the horizontal seat 56, creates a U-shaped water spray pattern which is applied upwardly against the buttocks of the occupant seated on the hydrotherapy seat 14. The occupant's head may rest on the front surface 12A of the spa shell, in the area where the seat back 58 merges with rim 60. Preferably, the spa shell is provided with an acrylic finish on the interior surface 12A. While a motor M is shown as being supplied with electricity from a source 40 through a rheostat 38, such is merely an example of an arrangement so that the speed of the pump 24 may be varied to control the flow rate of recirculated water through the supply manifold chamber 17. Alternatively, the motor 34 may be a two-speed motor such that the pump operates at only two speeds, one low and one high. By placing the small diameter apertures or holes 18 within the channels 64, the water sprays as at 66, FIG. 1, entering the spa 10 below the water level L, are spaced slightly rearwardly of the skin of the occupant, an arrangement which is quite comfortable to the occupant subject to a gentle hydrotherapy massage within hydrotherapy seat 14.

Upon closure of a switch 36, FIG. 1, electrical current flows from an electrical source 40 through the electrical leads 41 to the motor 34 labeled M, operating the pump 24, and labeled P at a given speed. Water under pressure as indicated by the arrows 68 enters the inlet fitting 19 of the water supply manifold 16, passes through the manifold chamber 17 and exits through the multiple apertures or holes 18 in the spa shell into the hydrotherapy seat 14 area of the spa enclosure. The hollow manifold 16 is sealably fixed at edges thereof to the exterior of the spa shell 12 and is spaced therefrom to define with the spa shell the manifold chamber 17. As may be appreciated, the apertures or holes 18 can be arranged in any pattern, as for instance in row and column fashion to give a desired hydrotherapy action with general massage to the exterior skin of the occupant of the hydrotherapy seat 14. Decreasing the resistance to the current flow through lines 41 to motor 34, results in increased water flow rate and higher pressure jets of water as at 66 entering the interior of the spa shell. The water W of level L exits the interior of the spa shell 12 through an outlet port 30 within the shell bottom wall 50 and circulates in accordance with arrows 70, through water outlet pipe 26, to the suction side of the variable speed pump 24. With a relatively large number of small diameter apertures or holes 18 within the spa shell at the hydrotherapy seat 14 opening from a common manifold chamber 17, the water W diffuses gently from each hole and comes into contact with the skin of the occupant, almost immediately upon entering the interior of the spa shell 12. A gentle massaging action by numerous small outlet jets in the seat area results. No air is introduced into the water stream 68 directed to manifold chamber 17, unlike hydrotherapy spa or hot tub plumbing conventional for such spas 10. The massaging action is always gentle due to the relatively large number of apertures 18. The hydrotherapy seat 14 discharges only water in a dedicated area of the spa and defined by the pattern of apertures or holes 18 as clearly seen in FIG. 2.

While the instant invention has been shown and described herein in terms of a preferred embodiment, it should be recognized, however, that departures may be made therefrom without departing from the scope of the invention as set forth in the following claims.

What is claimed is:

1. In a hydrotherapy spa comprising a molded fiberglass reinforced resin plastic waterproof spa shell having an interior and an exterior and defining a receptacle for holding water and being generally of U-shape in vertical section, said spa shell including at least one horizontal seat portion and an integral seat back extending upwardly therefrom, the improvement comprising a localized hydrotherapy seat structure within said spa shell including a hollow water supply manifold sealably fixed to the exterior of said spa shell at a seat area overlying at least a portion of the seat back and being spaced rearwardly from said spa shell at said seat back to form a manifold chamber, a plurality of nested U-shaped recessed channels within the seat back of the hydrotherapy seat structure, a plurality of longitudinally spaced small diameter apertures in a bottom of each of said nested recessed channels opening directly into the interior of said manifold chamber at a position below the level of water normally within said spa shell and means for supplying water under pressure from the spa interior to an inlet port within said water supply manifold opening to the interior of said manifold chamber, such that water is ejected at low velocity and low pressure through said plurality of small diameter apertures under recirculation back into said spa interior, whereby water under pressure floods the manifold and escapes into the spa interior simultaneously through all of said apertures in the bottom of each of said channels with the apertures open to the interior of the spa shell at some distance from the skin of an occupant seated within said therapy seat thereby gently massaging said occupant.

* * * * *